US011466609B2

(12) United States Patent
Ouzts

(10) Patent No.: US 11,466,609 B2
(45) Date of Patent: Oct. 11, 2022

(54) TURBO AIR COOLER

(71) Applicant: Ennovare, LLC, Hallsville, TX (US)

(72) Inventor: Eric R. Ouzts, Hallsville, TX (US)

(73) Assignee: Ennovare, LLC, Hallsville, TX (US)

( * ) Notice: Subject to any disclaimer, the term of this patent is extended or adjusted under 35 U.S.C. 154(b) by 0 days.

(21) Appl. No.: 17/384,086

(22) Filed: Jul. 23, 2021

(65) Prior Publication Data

US 2022/0170411 A1 Jun. 2, 2022

Related U.S. Application Data

(60) Provisional application No. 63/120,227, filed on Dec. 2, 2020.

(51) Int. Cl.
*F02B 29/04* (2006.01)
*F02D 19/02* (2006.01)

(52) U.S. Cl.
CPC ..... *F02B 29/0456* (2013.01); *F02B 29/0425* (2013.01); *F02B 29/0475* (2013.01); *F02D 19/022* (2013.01)

(58) Field of Classification Search
CPC ..... F02B 29/0456; F02B 29/0425; F02B 29/0475; F02D 19/022
USPC ..... 123/563
See application file for complete search history.

(56) References Cited

U.S. PATENT DOCUMENTS 4,104,999 A * 8/1978 Ullrich ..... F28F 9/0234 261/DIG. 51
4,286,655 A * 9/1981 Trojani ..... F28F 1/10 138/38
4,306,619 A * 12/1981 Trojani ..... F28F 1/42 165/179
4,688,383 A * 8/1987 Targa Pascual ..... F01P 3/20 60/599
5,081,977 A * 1/1992 Swenson ..... F17C 9/02 123/527
5,287,917 A * 2/1994 Cannata ..... F28D 7/106 165/154
5,375,582 A * 12/1994 Wimer ..... F17C 9/04 123/563
5,390,646 A * 2/1995 Swenson ..... F02M 21/06 123/525

(Continued)

FOREIGN PATENT DOCUMENTS

GB 2404949 A * 2/2005 ..... F02D 19/022
WO WO-02090750 A1 * 11/2002 ..... F02D 19/022

*Primary Examiner* — J. Todd Newton

(74) *Attorney, Agent, or Firm* — Conley Rose, P.C.; William H. Dietrich

(57) ABSTRACT

An air cooler for a natural gas engine. The air cooler includes a cooler body having an air inlet, an air outlet, a natural gas inlet, and a natural gas outlet, wherein the air inlet is configured to receive air and the air outlet is configured to discharge the air, and wherein the natural gas inlet is configured to receive natural gas and the natural gas outlet is configured to discharge the natural gas; and a plurality of cooling tubes disposed within the cooler body between the air inlet and the air outlet and in fluid communication with the natural gas inlet and the natural gas outlet, wherein the plurality of cooling tubes are configured to draw heat away from the air using the natural gas when the air flows through the cooler body from the air inlet to the air outlet and passes over the plurality of cooling tubes.

17 Claims, 6 Drawing Sheets

(56) References Cited

U.S. PATENT DOCUMENTS

| | | | | |
|---|---|---|---|---|
| 5,549,096 | A * | 8/1996 | Swenson | F02D 23/00 123/564 |
| 5,655,599 | A * | 8/1997 | Kasprzyk | F28F 13/14 165/133 |
| 6,793,012 | B2 * | 9/2004 | Fang | F28D 1/0443 165/140 |
| 9,638,118 | B2 * | 5/2017 | Schaller | F02D 19/0647 |
| 10,082,109 | B2 * | 9/2018 | Engfehr | F01P 3/20 |
| 2009/0031999 | A1 * | 2/2009 | Erickson | F02B 29/0443 123/563 |
| 2009/0126372 | A1 * | 5/2009 | Faka | F17C 7/04 60/641.1 |
| 2009/0126691 | A1 * | 5/2009 | Bach | F02B 37/00 123/480 |
| 2010/0018672 | A1 * | 1/2010 | Yang | F28D 7/0008 165/104.11 |
| 2013/0048257 | A1 * | 2/2013 | Perry | F28D 7/106 165/154 |
| 2014/0209070 | A1 * | 7/2014 | Gleeson | F02M 21/06 123/543 |
| 2015/0083055 | A1 * | 3/2015 | Melanson | F02G 5/04 123/2 |
| 2015/0260131 | A1 * | 9/2015 | Riley | F25J 3/04533 123/253 |
| 2016/0090873 | A1 * | 3/2016 | Weissenmayer | F02G 5/02 60/618 |
| 2016/0298556 | A1 * | 10/2016 | Schaller | F02D 19/0673 |

* cited by examiner

TURBO AIR COOLER

CROSS-REFERENCE TO RELATED APPLICATIONS

This patent application claims the benefit of U.S. Provisional Patent Application No. 63/120,227 filed Dec. 2, 2020 by Eric Ourts and titled "Turbo Air Cooler," which is hereby incorporated by reference.

TECHNICAL FIELD

The present disclosure is generally related to the natural gas engines and, in particular, to a supplemental cooling system for a natural gas engine.

BACKGROUND

Industrial natural gas engines, such as the Caterpillar G516 NA available from Caterpillar, Inc., often include an aftercooler. The purpose of the aftercooler is to reduce the temperature of engine intake air. For example, the aftercooler may be tasked with reducing a temperature of the engine intake air from between about 200 degrees Fahrenheit (° F.) to about 300° F. down to a preferred operating temperature of about 130° F. using the cooling system of the natural gas engine. However, the aftercooler is only able to cool the engine intake air down to between about 160° F. to about 170° F. in practical applications. Because the natural gas engine is forced to operate using engine intake air above the preferred operating temperature, the natural gas engine operates less efficiently than desired.

SUMMARY

The disclosed aspects/embodiments provide a turbo air cooler and system configured to reduce a temperature of the engine intake air in a natural gas engine using natural gas instead of ambient air. By reducing the engine intake air down to, or closer to, the preferred operating temperature using natural gas, the turbo air cooler and system allow the natural gas engine to operate efficiently.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a turbo air cooler and system configured to reduce a temperature of the engine intake air in a natural gas engine using natural gas instead of ambient air. By reducing the engine intake air down to, or closer to, the preferred operating temperature of the natural gas engine using natural gas, the turbo air cooler and system allow the natural gas engine to operate more efficiently. Because the natural gas engine is able to operate more efficiently, fuel use by the natural gas engine is reduced and there is a reduction in emissions from the natural gas engine.

Figure 1:
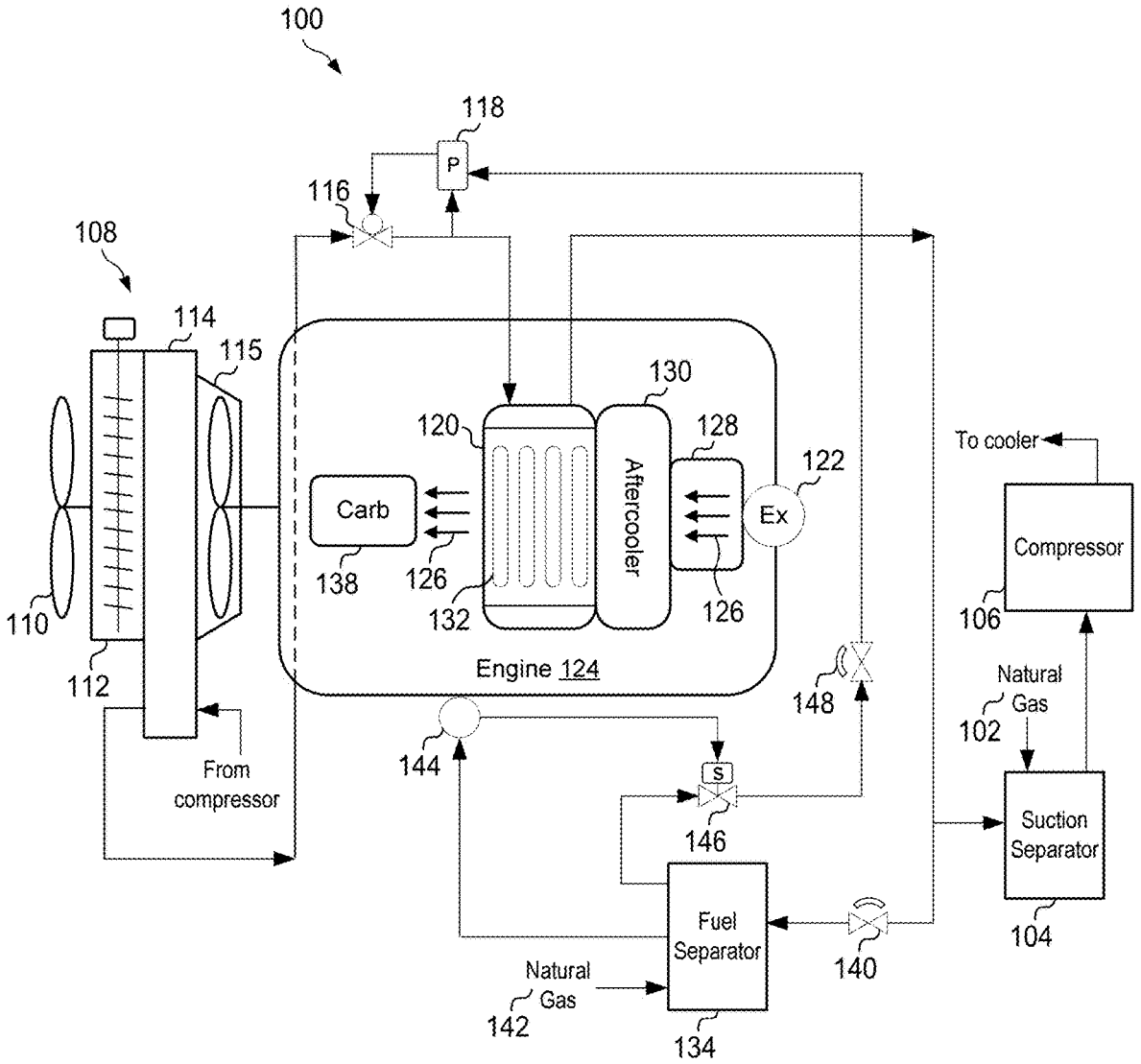
FIG. 1 is a schematic diagram of a natural gas compression operation.

FIG. 1 is a schematic diagram of a natural gas compression operation 100 according to an embodiment of the disclosure. As shown, the natural gas compression operation 100 comprises a natural gas source 102. The natural gas source 102 is configured to supply natural gas to the natural gas compression operation 100. In an embodiment, the natural gas source 102 comprises a natural gas pipeline or natural gas obtained from the ground.

The natural gas source 102 supplies natural gas to a suction separator 104. The suction separator 104 is configured to store unused natural gas for later use. In an embodiment, suction separator 104 receives and/or stores the natural gas at a pressure of between about 20 pounds per square inch (psi) and about 150 psi.

The suction separator 104 is coupled to a compressor 106 by, for example, piping configured to transport the natural gas. The compressor 106 is configured to compress the natural gas received from the suction separator 104. In an embodiment, the compressor 106 compresses the natural gas to a pressure of about 1,000 psi to about 1,100 psi. At the discharge of the compressor 106, the natural gas has a temperature of about 250° F.

The compressor 106 is coupled to a cooling system 108 by, for example, piping configured to transport the natural gas. As shown, the cooling system 108 comprises one or more fans 110, a radiator 112, a cooling manifold 114, and a fan housing 115. As shown, the natural gas from the compressor 106 enters the cooling manifold 114. In an embodiment, the cooling manifold 114 includes both natural gas and antifreeze sections. The fans 110 and the radiator 112 use ambient air, which has a temperature of between about 50° F. to about 120° F., to reduce the temperature of the natural gas to about 120° F. The pressure of the natural gas remains about the same.

The cooling system 108 is coupled to a control valve 116 by, for example, piping configured to transport the natural gas. The control valve 116 (a.k.a., expansion valve) is configured to reduce the pressure of the natural gas, which results in a corresponding pressure drop. In an embodiment, the control valve 116 is configured to reduce the pressure of the natural gas from between about 1,000 psi and about 1,100 psi to about 50 psi to about 150 psi. This results in a temperature drop from about 120° F. to between about 25° F. and 75° F.

In an embodiment, a ball valve (not shown) may be included in the piping coupling the cooling system 108 to the control valve 116. Such a ball valve may act as a shutoff valve to temporarily prevent the natural gas from flowing from the cooling system 108 to the control valve 116.

The control valve 116 is coupled to a pressure pilot 118 by, for example, piping configured to transport the natural gas. The pressure pilot 118 is configured to sense a pressure of the natural gas discharged from the control value 116. The pressure pilot 118 then uses the sensed pressure to actuate the control valve 116 to ensure the control valve 116 is discharging the natural gas at a desired pressure (e.g., a pressure between about 50 psi to about 150 psi).

The control valve 116 is also coupled to an air cooler 120 by, for example, piping configured to transport the natural gas. The air cooler 120 may be referred to herein as a turbo air cooler. As will be more fully explained below, the air cooler 120 may be used to provide additional or supplemental cooling.

As shown in FIG. 1, the exhaust 122 from the natural gas engine 124 is fed into one or more turbo chargers (not shown) and pulled through one or more air filters (not shown) to generate engine intake air 126. The engine intake air 126 in the air intake manifold 128 is at a temperature of between about 200° F. to about 300° F. Thus, the engine intake air 126 needs to be significantly cooled before the engine intake air 126 can be used by the natural gas engine 124. Indeed, the preferred operating temperature of the engine intake air 126 is about 130° F.

In order to cool the engine intake air 126, the engine intake air 126 is fed into an aftercooler 130. The aftercooler 130 employs the cooling system 108 of the natural gas engine 124 to reduce the temperature of the engine intake air 126. In particular, the aftercooler 130 directs the engine intake air 126 through the aftercooler 130 and antifreeze, which is circulating between the aftercooler 130 and the cooling manifold 114 of the cooling system 108, and draws heat away from the engine intake air 126. Ideally, the aftercooler 130 is tasked with reducing a temperature of the engine intake air 126 from between about 200° F. to about 300° F. down to a preferred operating temperature of about 130° F. using the cooling system 108 of the natural gas engine 124. However, the aftercooler 130 is only able to cool the engine intake air 126 down to between about 160° F. to about 170° F. in practical applications. This is due, at least in part, to the aftercooler 130 relying on the cooling system 108, which uses antifreeze and ambient air.

The problem of engine intake air 126 at an elevated temperature is resolved by the air cooler 120, which uses natural gas circulating through a plurality of cooling tubes 132 to cool the engine intake air 126. The plurality of cooling tubes 132 are configured to receive the natural gas from the control valve 116, circulate the natural gas through the air cooler 120, and then discharge the natural gas toward a fuel separator 134.

As shown in FIG. 1, the air cooler 120 receives the engine intake air 126 from the aftercooler 130 at a temperature of between about 160° F. to about 170° F. and reduces the temperature of the engine intake air 126 down to between about 125° F. to about 140° F. using the natural gas circulating through the plurality of cooling tubes 132. That is, the plurality of cooling tubes 132 draw heat away from the engine intake air 126 using the natural gas when the engine intake air 126 flows through the air cooler 120 and passes over the plurality of cooling tubes 132. Thus, the same natural gas used to run the natural gas engine 124 is also used by the air cooler 120 to cool the engine intake air 126.

The air cooler 120 discharges the engine intake air 126 at between about 125° F. to about 140° F. The engine intake air 126 is then supplied to a carburetor 138 of the natural gas engine 124. The intake air 126, which has been sufficiently cooled to within the desired range noted herein, allows the natural gas engine 124 to run more efficiently.

As noted above, the fuel separator 134 is configured to receive the natural gas discharged from the air cooler 120. A pressure regulator 140 may be included in the piping between the air cooler 120 and the fuel separator 134 to reduce the pressure of the natural gas discharged from the air cooler 120. In an embodiment, the pressure regulator 140 reduces the pressure of the natural gas to between about 35 psi to about 80 psi.

The fuel separator 134 is supplied with natural gas by natural gas source 142. The natural gas source 142 may be the same as, or different than, the natural gas source 102. The fuel separator 134 is configured to supply the natural gas received from the natural gas source 142 to a fuel supply regulator 144 by, for example, natural gas piping. The fuel supply regulator 144 supplies the natural gas to the natural gas engine 124 in order for the natural gas engine 124 to operate.

The fuel supply regulator 144 is also configured to supply natural gas to a solenoid valve 146. As shown, the solenoid valve 146 is coupled to the fuel separator 134 by, for example, natural gas piping. When the fuel supply regulator 144 supplies natural gas to the solenoid valve 146, natural gas flows from the fuel separator 134 and is able to activate the pressure pilot 118. When the fuel supply regulator 144 restricts natural gas to the solenoid valve 146, no natural gas flows from the fuel separator 134 and the pressure pilot 118 is deactivated. In an embodiment, a pressure regulator 148 is disposed between the solenoid valve 146 and the pressure pilot 118 to regulate the pressure of the natural gas to between 0 psi to 60 psi.

It should be recognized that the natural gas compression operation 100 may include additional components in practical applications.

Figure 2:
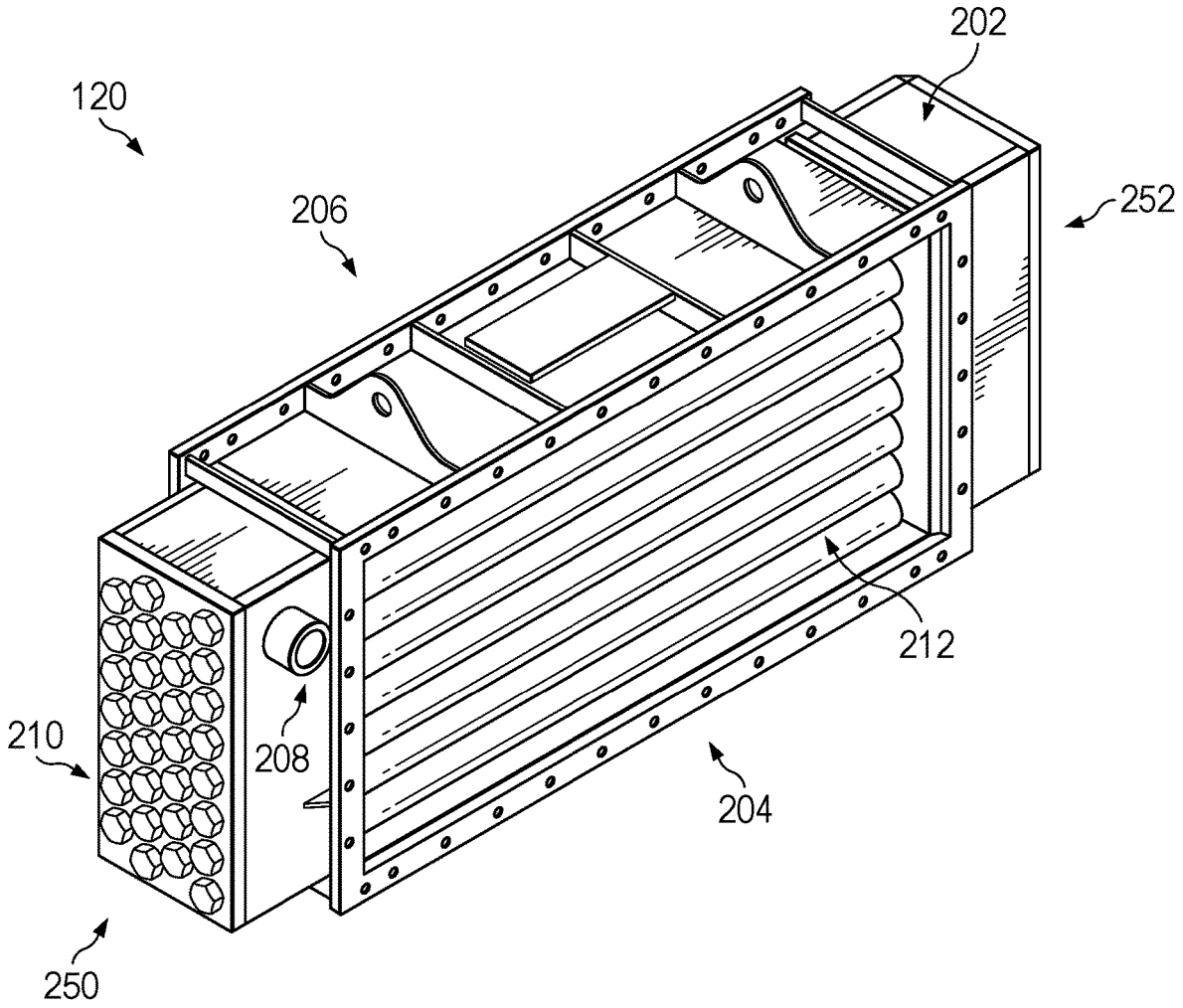
FIG. 2 is a perspective view of an air cooler used within the natural gas compression operation of FIG. 1.
Figure 3:
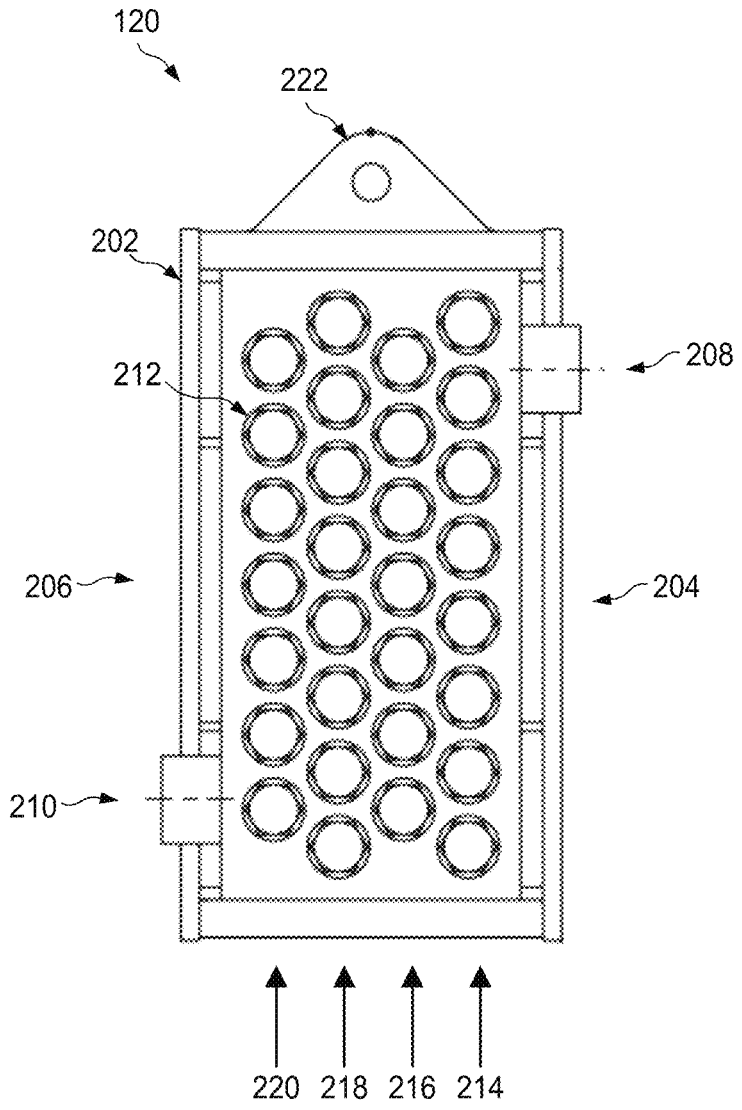
FIG. 3 is an end view of the air cooler used within the natural gas compression operation of FIG. 1.
Figure 4:
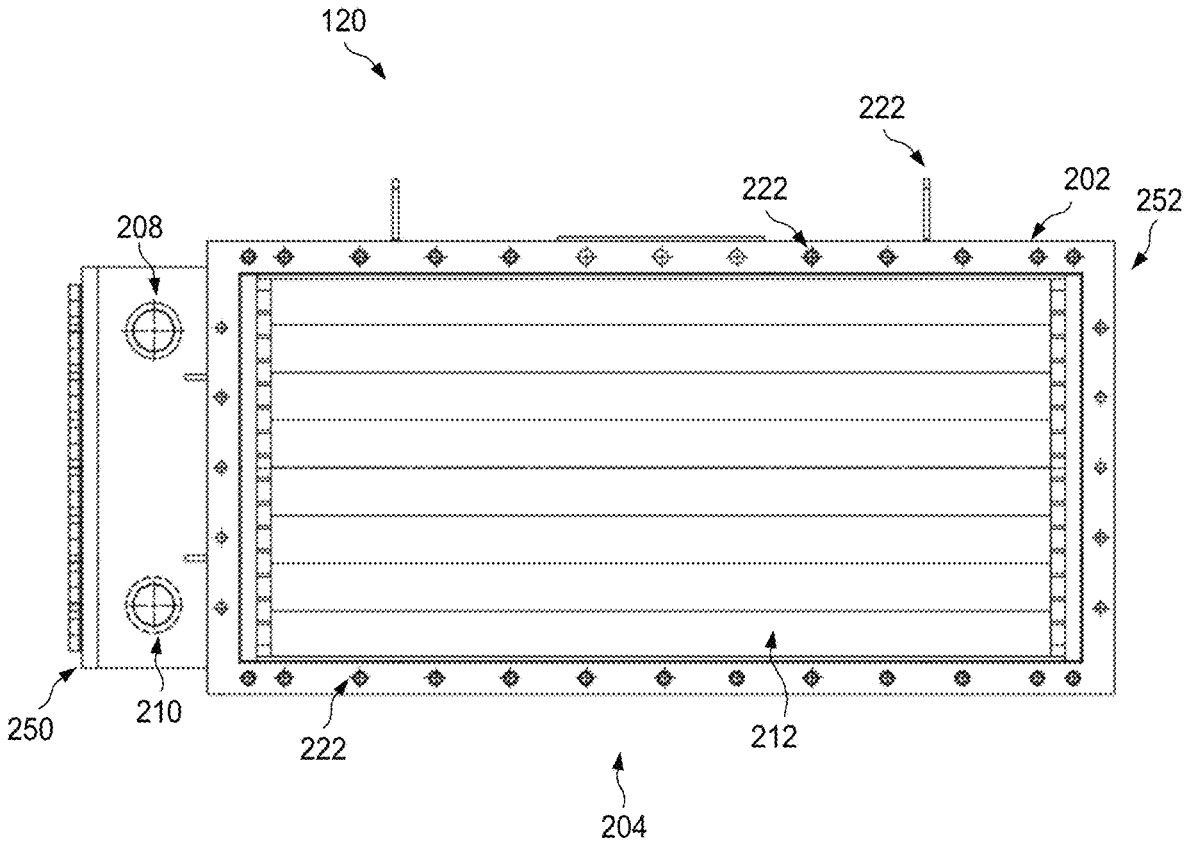
FIG. 4 is an air inlet side view of the air cooler used within the natural gas compression operation of FIG. 1.

FIGS. 2, 3, and 4 are a perspective view, an end view, and an air inlet side view of the air cooler 120 of FIG. 1. The air cooler 120 includes a cooler body 202 having an air inlet 204, an air outlet 206, a natural gas inlet 208, a natural gas outlet 210, and a plurality of cooling tubes 212. The air inlet 204 is configured to receive air. For example, the air inlet 204 is configured to receive the engine intake air 126 discharged from the aftercooler 130. The air outlet 206 and the air inlet 204 are on opposing sides of the cooler body 202. In an embodiment, one or both of the air inlet 204 and the air outlet 206 are rectangular openings formed in the cooler body 202.

The natural gas inlet 208 is configured to receive natural gas, and the natural gas outlet 210 is configured to discharge the natural gas. For example, the natural gas inlet 208 is configured to receive natural gas from the control valve 116, and the natural gas outlet 210 is configured to discharge the natural gas to the fuel separator 134. In an embodiment, the natural gas inlet 208 and the natural gas outlet 210 are on opposing sides of the cooler body 202. In an embodiment, one or both of the natural gas inlet 208 and the natural gas outlet 210 are circular ports or couplings formed on the cooler body 202.

The natural gas inlet 208 and the natural gas outlet 210 are in fluid communication with the plurality of cooling tubes 212. The cooling tubes 212 are arranged in multiple passes within the cooler body 202. For example, a first pass 214 of the cooling tubes 212 is configured to receive the natural gas from the natural gas inlet 208. The natural gas flows through the first pass 214 from a first end 250 of the cooler body 202 toward a second end 252 of the cooler body. 202. The natural gas then enters a second pass 216 where the natural gas flows from the second end 252 of the cooler body 202 back toward the first end 250. The natural gas then enters a third pass 218 where the natural gas flows from the first end 250 of the cooler body 202 back toward the second end 252. The natural gas then enters a fourth pass 220 where the natural gas flows from the second end 252 of the cooler body 202 back toward the first end 250. Once completing the fourth pass 220, the natural gas is discharged at the natural gas outlet 210. While four passes have been described, it should be recognized that more or fewer passes may be used in practical applications. That is, multiple passes or a single pass may be utilized.

As shown in FIGS. 2-4, in an embodiment the plurality of cooling tubes 212 may be disposed in the cooler body 202 perpendicular to a direction that the air inlet 204 and the air outlet 206 are configured to direct the air through the cooler body 202. In an embodiment, the plurality of cooling tubes 212 may be disposed in the cooler body 202 perpendicular to a direction that the natural gas inlet 208 is configured to receive the natural gas and the natural gas outlet 210 is configured to discharge the natural gas from the cooler body 202.

In an embodiment, the cooler body 202 includes mounting components 222. The mounting components 222 may include various brackets and apertures permitting the air cooler 120 to be mounted to the aftercooler 130 and/or the natural gas engine 124.

Figure 5:
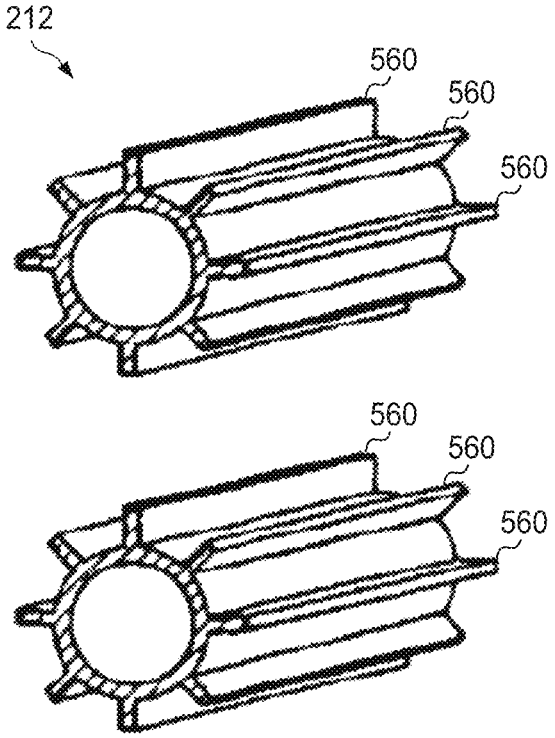
FIG. 5 is a perspective view of the plurality of cooling tubes used within the air cooler.

FIG. 5 is a perspective view of the plurality of cooling tubes 212. In an embodiment, one or more of the plurality of cooling tubes 212 includes radially-outwardly projecting fins 560. As shown, the fins 560 extend longitudinally along each of the cooling tubes.

Figure 6:
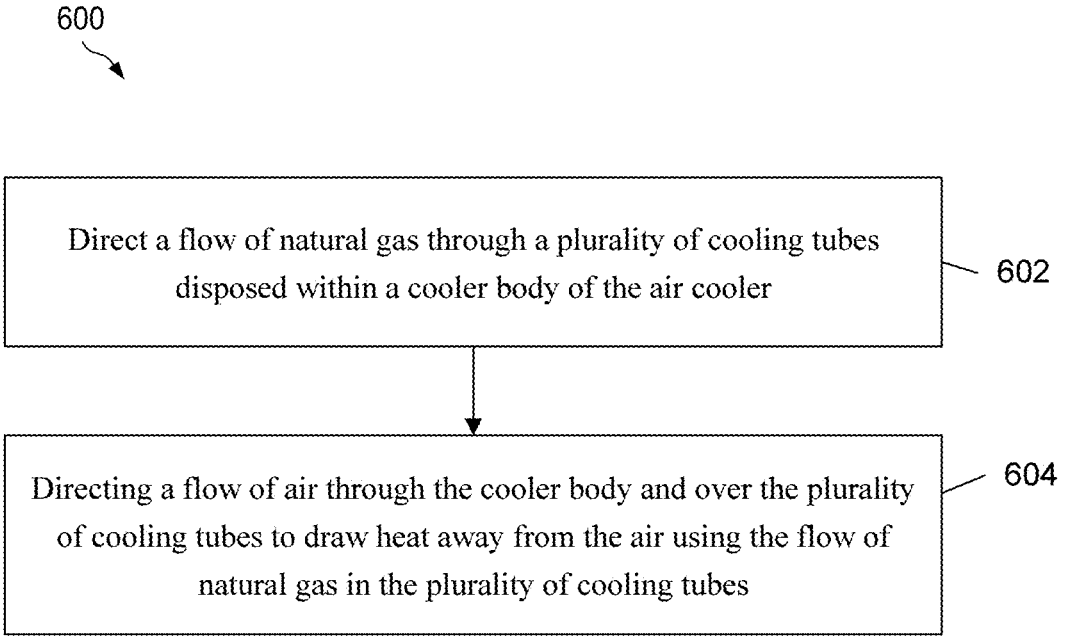
FIG. 6 is a method of cooling air implemented by the air cooler in a natural gas engine within the natural gas compression operation of FIG. 1.

FIG. 6 is a method 600 of cooling air (e.g., engine intake air 126) implemented by an air cooler (e.g., air cooler 120) in a natural gas engine (e.g., engine 124). The method 600 may be implemented to cool engine intake air down to the preferred operating temperature of a natural gas engine.

In block 602, a flow of natural gas is directed through a plurality of cooling tubes 212 disposed within a cooler body 202 of the air cooler 120. In block 604, a flow of air is directed through the cooler body 202 and over the plurality of cooling tubes 212 to draw heat away from the air using the flow of natural gas in the plurality of cooling tubes 212.

In an embodiment, the method 600 further comprises reducing a pressure of the natural gas using a control valve 116 prior to the flow of the natural gas being directed through the plurality of cooling tubes 212. In an embodiment, the method 600 further comprises controlling the pressure of the natural gas flowing through the plurality of cooling tubes 212 using a pressure pilot 118.

In an embodiment, the method 600 further comprises activating the pressure pilot 118 and the control valve 116 by providing the flow of the natural gas to a solenoid valve 146, and deactivating the pressure pilot 118 and the control valve 116 by terminating the flow of the natural gas to the solenoid valve 146.

In an embodiment, the method 600 further comprises receiving the air expelled from an aftercooler 130 of the natural gas engine 124 at an air inlet 204 of the cooler body 202. In an embodiment, the air expelled from the aftercooler 130 is between about 160° F. and about 170° F. In an embodiment, the method 600 further comprises reducing a temperature of the air received at the air inlet 204 to between about 125° F. and about 140° F. at an air outlet 206 of the air cooler 120.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, components, techniques, or methods without departing from the scope of the present disclosure. Other examples of changes, substitutions, and alterations are ascertainable by one skilled in the art and may be made without departing from the spirit and scope disclosed herein.

What is claimed is:

1. An air cooler for a natural gas engine, comprising, a cooler body having an air inlet and an air outlet on opposing sides of air flow channel, a natural gas inlet, and a natural gas outlet, wherein the air inlet is configured to receive air and the air outlet is configured to discharge the air, wherein the natural gas inlet is configured to receive natural gas and the natural gas outlet is configured to discharge the natural gas, and wherein dimensions of the air flow channel remain constant between the air inlet and the air outlet; and a plurality of cooling tubes disposed within the air flow channel of the cooler body and in fluid communication with the natural gas inlet and the natural gas outlet, wherein the plurality of cooling tubes are arranged in multiple passes that flow the natural gas in opposite directions within the cooler body in a repeating pattern to draw heat away from the air using the natural gas when the air flows through the cooler body from the air inlet to the air outlet and passes over the plurality of cooling tubes.

2. The air cooler of claim 1, wherein each of the plurality of cooling tubes has radially-outwardly projecting fins.

3. The air cooler of claim 1, wherein the plurality of cooling tubes are arranged in four of the multiple passes within the cooler body.

4. The air cooler of claim 1, wherein the plurality of cooling tubes are disposed in the cooler body perpendicular to a direction that the air inlet and the air outlet are configured to direct the air through the cooler body.

5. The air cooler of claim 1, wherein the plurality of cooling tubes are disposed in the cooler body perpendicular to a direction that the natural gas inlet is configured to receive the natural gas and the natural gas outlet is configured to discharge the natural gas from the cooler body.

6. The air cooler of claim 1, wherein the cooler body includes an inlet flange disposed around the air inlet, wherein the inlet flange includes a plurality of mounting apertures passing therethrough, and wherein the inlet flange and the mounting apertures are configured to mount the air cooler to an outlet side of an aftercooler of the natural gas engine.

7. The air cooler of claim 1, wherein the air inlet is configured to receive the air discharged from an aftercooler of the natural gas engine.

8. The air cooler of claim 7, wherein the air cooler is configured to reduce a temperature of the air received at the air inlet to between about 125 degrees Fahrenheit (° F.) and about 140° F. at the air outlet.

9. A method of cooling air implemented by an air cooler in a natural gas engine, comprising:

reducing a pressure of natural gas using a control valve;

directing a flow of natural gas through a plurality of cooling tubes disposed within a cooler body of the air cooler following reduction of the pressure;

controlling the pressure of the natural gas flowing through the plurality of cooling tubes using a pressure pilot; and directing a flow of air through the cooler body and over the plurality of cooling tubes to draw heat away from the air using the flow of natural gas in the plurality of cooling tubes, wherein the pressure pilot and the control valve are activated by providing the flow of the natural gas to a solenoid valve, and wherein the pressure pilot and the control valve are deactivated by terminating the flow of the natural gas to the solenoid valve.

10. The method of claim 9, wherein each of the plurality of cooling tubes has radially-outwardly projecting fins.

11. The method of claim 9, wherein the plurality of cooling tubes are arranged in multiple passes within the cooler body.

12. The method of claim 9, wherein the plurality of cooling tubes are disposed in the cooler body perpendicular to a direction that an air inlet and an air outlet of the cooler body are configured to direct the air through the cooler body.

13. The method of claim 9, further comprising receiving the air expelled from an aftercooler of the natural gas engine at an air inlet of the cooler body, wherein the air expelled from the aftercooler is between about 160 degrees Fahrenheit (° F.) and about 170° F.

14. The method of claim 13, further comprising reducing a temperature of the air received at the air inlet to between about 125 degrees Fahrenheit (° F.) and about 140° F. at an air outlet of the air cooler.

15. An air cooler system for a natural gas engine, comprising, an air cooler, comprising:

a cooler body having an air inlet, an air outlet, a natural gas inlet, and a natural gas outlet, wherein the air inlet is configured to receive air and the air outlet is configured to discharge the air, and wherein the natural gas inlet is configured to receive natural gas and the natural gas outlet is configured to discharge the natural gas; and a plurality of cooling tubes disposed within the cooler body between the air inlet and the air outlet and in fluid communication with the natural gas inlet and the natural gas outlet, wherein the plurality of cooling tubes are configured to draw heat away from the air using the natural gas when the air flows through the cooler body from the air inlet to the air outlet and passes over the plurality of cooling tubes;

a control valve coupled to the air cooler, wherein the control valve is configured to reduce a pressure of the natural gas within the plurality of cooling tubes;

a pressure pilot coupled to the control valve, wherein the pressure pilot is configured to control the pressure of the natural gas within the plurality of cooling tubes; and a solenoid valve coupled to the pressure pilot, wherein the solenoid valve is configured to activate the pressure pilot and the control valve upon receipt of a flow of the natural gas and to deactivate the pressure pilot and the control valve when the flow of the natural gas has ceased.

16. The air cooler system of claim 15, wherein each of the plurality of cooling tubes has radially-outwardly projecting fins.

17. The air cooler system of claim 15, wherein the plurality of cooling tubes are arranged in multiple passes within the cooler body.

* * * * *